United States Patent [19]

Zink

[11] Patent Number: 4,527,795

[45] Date of Patent: Jul. 9, 1985

[54] TETHERED SWIMMER'S TANK

[76] Inventor: John S. Zink, P.O. Box 7388, Tulsa, Okla. 74105

[21] Appl. No.: 93,060

[22] Filed: Nov. 13, 1979

[51] Int. Cl.[3] ..... A63B 69/12

[52] U.S. Cl. ..... 272/71; 4/498; 4/513; 73/379; 272/26; 434/254

[58] Field of Search ..... 272/71, 26, 1 B; 35/29 B; 73/148, 379, 380, 381; 4/488, 494, 498, 503, 513; D21/252; D25/2; D23/55

[56] References Cited

U.S. PATENT DOCUMENTS

| | | | |
|---|---|---|---|
| D. 235,105 | 5/1975 | Doman | D23/55 |
| 2,825,224 | 3/1958 | Lindenauer et al. | 35/29 B UX |
| 3,412,409 | 11/1968 | Putney | 4/498 |
| 3,647,209 | 3/1972 | La Lanne | 73/379 X |
| 4,044,517 | 8/1977 | Schroter | D25/2 X |

FOREIGN PATENT DOCUMENTS

| | | | |
|---|---|---|---|
| 2014670 | 10/1971 | Fed. Rep. of Germany | 73/380 |
| 2653935 | 6/1978 | Fed. Rep. of Germany | 73/380 |
| 1385295 | 11/1964 | France | 35/29 B |
| 330482 | 6/1930 | United Kingdom | 272/71 |

OTHER PUBLICATIONS

Exerswim TM, Hans Sickinger Co., Pontiac, Mich., ©Hans Sickinger Co.-1976.

*Primary Examiner*—Robert E. Bagwill
*Assistant Examiner*—Arnold W. Kramer
*Attorney, Agent, or Firm*—Head, Johnson & Stevenson

[57] ABSTRACT

A tethered swimmer's tank for permitting a person to perform swimming exercises within a limited space being comprised of an open topped, water-filled tank and a harness device which is attached to said person for holding said person in a stationary position while perform various swimming exercises. A pulley is mounted to the tank behind the swimmer. An indicator is mounted forward of the swimmer within his/her field of view slightly above the top of the water and below the top of the tank. A cable passes around the pulleys with one end being attached to the harness and the other end attached to the indicator to measure the force exerted by the swimmer.

2 Claims, 5 Drawing Figures

TETHERED SWIMMER'S TANK

BACKGROUND OF THE INVENTION

1. Field of the Invention

The present invention relates to a small diameter swimming tank and, more particularly, to such a swimming tank which is provided with a harness mechanism which can be worn by the swimmer which prevents the forward motion of the swimmer thereby allowing the swimmer to exercise without the need of a full length swimming pool.

2. Description of the Prior Art

The public is becoming increasingly aware of the need for physical exercise and the benefits of good health therefrom. And physicians have stated that swimming is almost the "perfect" exercise. Many individuals have small swimming pools on their residences; however, due to the cost and the property size limitations, a pool of sufficient length to enable a swimmer to truly exercise is not generally available. Municipal pools are of sufficient lengths however, these pools are generally crowded and are closed during the fall, winter and spring months. Numerous health spas and other similar organizations have been established with pools, usually indoor pools, which would allow swimmers to truly exercise. These spas are located only in major communities and are generally very expensive to join. Further, any municipal or organizational pool may not be open at the hours at which a person may wish to swim and require transportation to and from the pool. In the past, small pools have been developed; however, none of these pools have been of a low cost, small size design with a mechanism designed to allow a swimmer to be maintained in a stationary position while exercising within the pool.

SUMMARY

The present invention generally provides an inexpensive, easily transportable swimming tank which permits a person to perform swimming exercises therein and which occupies a much smaller space than a full-sized swimming pool. The swimmer's tank may be located within a building, on top of or sunk into the earth.

The present invention, more particularly, comprises an open topped, water-filled tank and a harness device which is attached around the waist of the person. The harness holds the person in a stationary position while performing the swimming exercises, thereby, allowing true "swimming" to be performed within a limited space. The harness device is comprised of a waist belt attached around the person, a cable which extends from the waist belt through a hole in the tank and is secured on the outside thereof. An alternate harness device is comprised of a belt attached around the person, a plurality of pulleys mounted to the tank in front of and behind the person, an indicator device mounted to the tank in the field of view of the person, and a cable which passes around the pulleys. One end of the cable being attached to the swimmer's belt and the second end of the cable being attached to the indicator means. When a force is exerted by the swimmer on the cable, that force is visually displayed by the indicator device in equivalent distance travelled per minute of swimming at that force. The tethered swimmer's tank may be of various designs, preferably in a circular or teardropped-shaped.

DETAILED DESCRIPTION OF THE PREFERRED EMBODIMENTS

Figure 1:
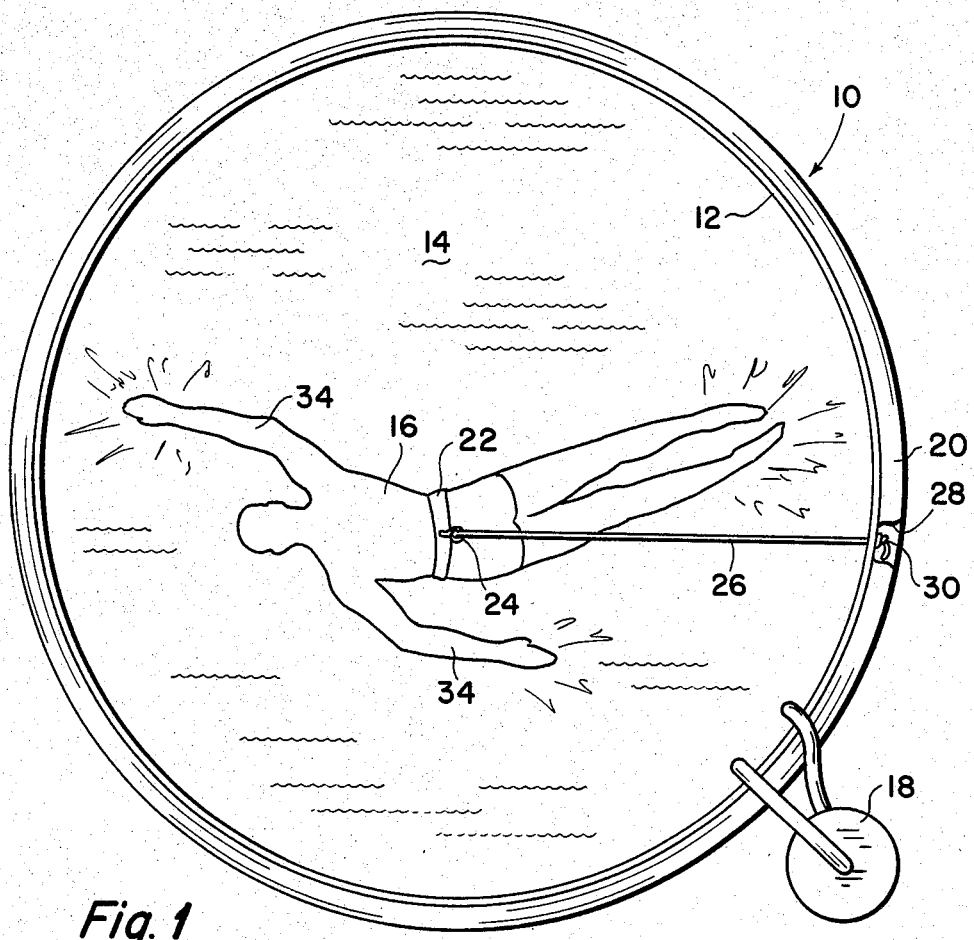
FIG. 1, is a top plan view of the tethered swimmer's tank embodying the present invention, with the outline of a swimmer therein.
Figure 2:
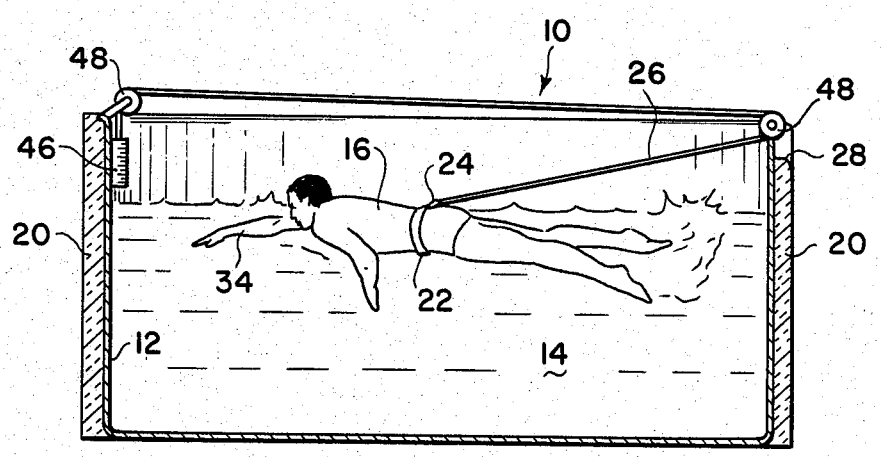
FIG. 2 is a side elevational cut-away view of the tank.

Referring to the drawings in detail, reference character 10 generally indicates a tethered swimmer's tank particularly designed for allowing a swimmer to perform various swimming exercises within a limited space. As shown in FIGS. 1 and 2, the tank 10 is composed of a circular open-topped tank 12, with water 14 contained therein, which may be constructed from metal, fiberglass or some other suitable material. The tank 12 is approximately 10 to 12 feet in diameter, thereby, allowing sufficient room for a swimmer 16 to perform swimming exercises therein. The swimmer's tank 10 is provided with a water heater and filtration system 18, which heats and conditions the water 14. Fiberglass or foam insulation 20 is placed around the exterior walls of the tank 12 which helps maintain the water 14 at a constant temperature.

Figure 3:
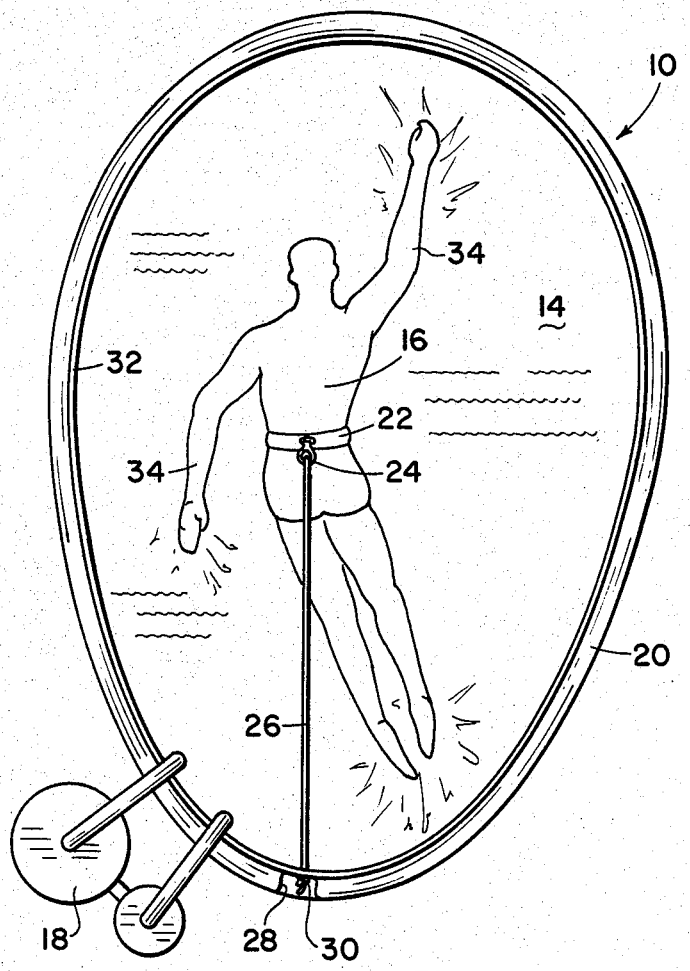
FIG. 3 is a top plan view of an alternate embodiment of the tank.
Figure 4:
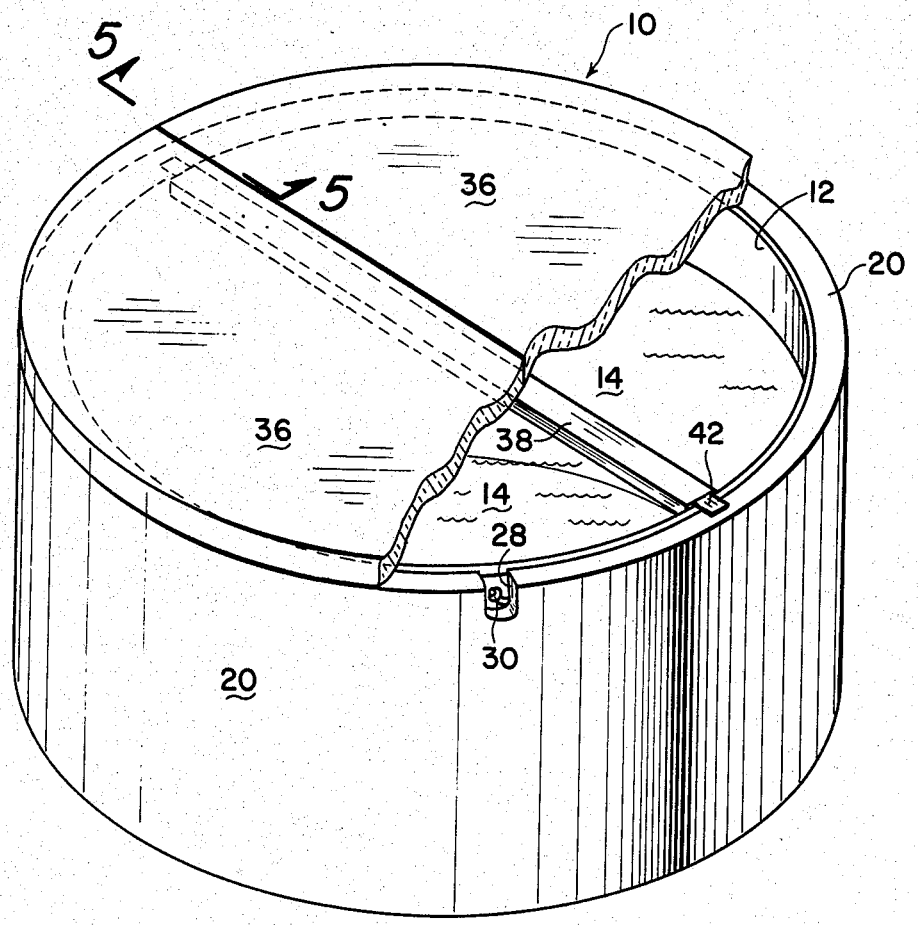
FIG. 4 is an oblique view of the tank, with panels covering the top thereof.

The swimmer's tank 10 may be sunk into the ground or may be placed upon the flooring of a building (not shown). After entering the water 14, the swimmer 16 places a waist belt 22 around his or her waist. The rear portion of the waist belt 22 is provided with a ring 24 to which one end of a cable 26 is attached. An opposite end of the cable 26 passes through a hole (not shown) in the tank 12, through a notch 28 in the insulation 20 and is secured thereto by means of a knot 30 or some other similar means of anchoring. The swimmer 16 is free to swim normally, but is tethered to the tank, thereby being maintained in a stationary position. As can be seen, the swimmer's tank 10 provides a means for allowing a person 16 to swim without the expense of a large and costly swimming pool. As shown in FIG. 3, the swimmer's tank 10 may be constructed with teardropped-shaped tank 32 which is of sufficient size across its widest portion to accommodate the swimmer's 16 outstretched arms 34, yet provides a saving of space and water over the circular tank 12.

Figure 5:
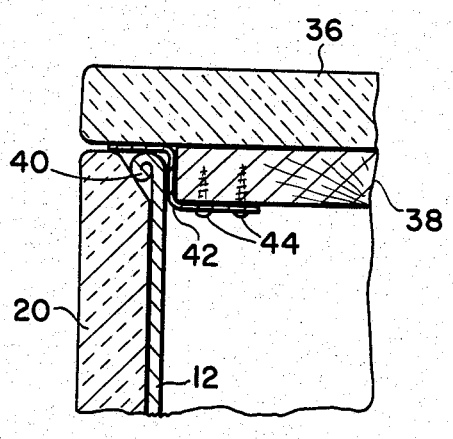
FIG. 5 is a side elevational view of the structure of the tank taken along line 5—5 of FIG. 4.

When not in use, two light-weight insulated covers 36 are placed over the tank 12 and rest upon a movable center support 38. As shown in FIG. 5, the top edge of the tank 12 is provided with a curled portion 40, which is provided to prevent injury to the swimmer 16 when entering or leaving the swimmer's tank 10. Each end of the support 38 is provided with a "z" shaped bracket 42, which is mounted to the support 38 by means of a plurality of screws 44. The brackets 42 rest upon the curled portion 40 of the tank 12 and permit the support 38 to be suspended above the tank 12.

As shown in FIG. 2, a force indicator 46 may be mounted within the tank 12 and within the field of vision of swimmer 16. The force indicator would be in communication with the cable 26 by means of pulleys 48. As the swimmer 16 strokes through the water 14, the tension placed upon the cable 26 by the swimmer 16 would be measured by the force indicator 46. The force indicator 46 would provide a visual indication of the swimming force which in turn would be converted into a measurement of distance per minute of swimming at such force.

Whereas the present invention has been described in particular relation to the drawings attached hereto, it should be understood that other and further modification of the invention, apart from those shown or suggested herein, may be made within the scope and spirit of this invention.

What is claimed is:

1. A tethered swimmer's tank for permitting a person to perform swimming motion within a limited space comprising a tank with water deep enough so that a person in a horizontal swimming position therein can perform said motion; a harness means comprised of a belt attached to said person; a plurality of pulleys mounted to said tank, one of said pulleys being mounted to said tank behind said person, and a second of said pulleys being mounted to said tank in front of said person; an indicator means mounted forward of said person within his/her field of view slightly above the top of said water and below the top of said tank; a cable passing around said pulleys, one end of said cable being attached to said harness while the other end of said cable is attached to said indicator means such that a force exerted by said person during said swimming motion is visually displayed by said indicator means in equivalent distance travelled per minute based on said person's swimming force.

2. A tethered swimmer's tank as in claim 1 whereby said tank is of teardrop shape so that said person is situated therein with his/her feet at the smaller dimension and his/her arms at the larger dimension of said tank based on the horizontal cross section of said tank.

* * * * *